United States Patent [19]

Mester

[11] 3,966,201

[45] June 29, 1976

[54] EXERCISING MACHINE

[76] Inventor: Joseph H. Mester, 373 S. Seguin Ave., New Braunfels, Tex. 78130

[22] Filed: June 10, 1975

[21] Appl. No.: 585,566

Related U.S. Application Data

[63] Continuation of Ser. No. 453,529, March 21, 1974, abandoned.

[52] U.S. Cl. ..... 272/72; 272/73; 272/DIG. 3; 272/132

[51] Int. Cl.[2] ..... A63B 21/22; A63B 23/04

[58] Field of Search ..... 272/58, 72, 73, 79 C, 272/79 D, DIG. 3, DIG. 4, 179 R

[56] References Cited

UNITED STATES PATENTS

| | | | |
|---|---|---|---|
| 2,252,868 | 8/1941 | Senn | 272/79 D |
| 2,921,791 | 1/1960 | Berne | 272/79 R |
| 3,058,742 | 10/1962 | Jaffe | 272/73 |
| 3,216,722 | 11/1965 | Odom | 272/73 |
| 3,782,721 | 1/1974 | Passera | 272/79 D |

FOREIGN PATENTS OR APPLICATIONS

| | | | |
|---|---|---|---|
| 1,153,143 | 5/1969 | United Kingdom | 272/79 C |

*Primary Examiner*—Richard C. Pinkham
*Assistant Examiner*—Harry G. Strappello
*Attorney, Agent, or Firm*—Clarence A. O'Brien; Harvey B. Jacobson

[57] ABSTRACT

An exercising machine having a frame provided with a hand lever assembly including independent hand levers, and a foot pedal assembly including cooperating pedals. Both the hand levers and pedals are movable against drag exerted on same by a belt brake assembly common to both the levers and pedals. A brake shoe assembly is advantageously associated with the hand levers to provide additional drag on the hand levers to hold same in a desired position against movement of the belts by actuation of the pedal assembly.

8 Claims, 7 Drawing Figures

EXERCISING MACHINE

This is a continuation of application Ser. No. 453,529, filed Mar. 21, 1974, and now abandoned.

BACKGROUND OF THE INVENTION

1. Field of the Invention

This invention relates generally to an exercising machine, and particularly to an exercising machine combining movements simulating bicycling, rowing, and the like.

2. Description of the Prior Art

U.S. Pat. Nos. 1,909,002, issued May 16, 1933 to N. M. oehlberg, 2,261,355, issued Nov. 4, 1941 to J. Flynn, 3,216,722, issued Nov. 9, 1965 to E. R. Odom, and 3,759,512, issued Sept. 18, 1973 to Yount et al, disclose exercising machines having some structural features similar to features of the present invention.

SUMMARY OF THE INVENTION

It is an object of the present invention to provide an improved exercising machine of simplified, yet rugged and reliable construction.

It is another object of the present invention to provide an exercising machine affording a greater variety of useful exercises than possible with conventional machines of the same general kind.

These and other objects are achieved according to the present invention by providing an exercising machine having: a frame; a hand lever assembly mounted on the frame for selective actuation by an exerciser's hands; a foot pedal assembly mounted on the frame for selective actuation by the exerciser's feet, with the foot pedal assembly being operated independently of the hand lever assembly; and a brake assembly common to both the hand lever assembly and the foot pedal assembly for applying a drag to both assemblies.

The hand lever assembly is advantageously comprised of a pair of hand levers pivotally mounted on the frame so that each of the hand levers is movable independently of the other hand lever. A brake shoe assembly is associated with the hand levers for supplementing the drag applied to the hand levers by the common brake assembly.

The foot pedal assembly preferably includes a pair of pedals mounted on a pair of oppositely directed pedal cranks rotatably mounted on the frame.

The brake assembly common to both the hand lever assembly and foot pedal assembly includes a pair of drums mounted on shafts pivotally mounting the hand levers to the frame. Each of these drums is connected to a respective one of the hand levers to form a set therewith. A pair of pulleys are associated with the foot pedal assembly, with each of the pulleys being mounted on a respective one of a pair of pedal cranks partially forming the foot pedal assembly for rotation by the cranks. Belts are arranged over the drums and pulleys for transmitting a static or dynamic force generated by either the drums or pulleys to the other of the pulleys or drums.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
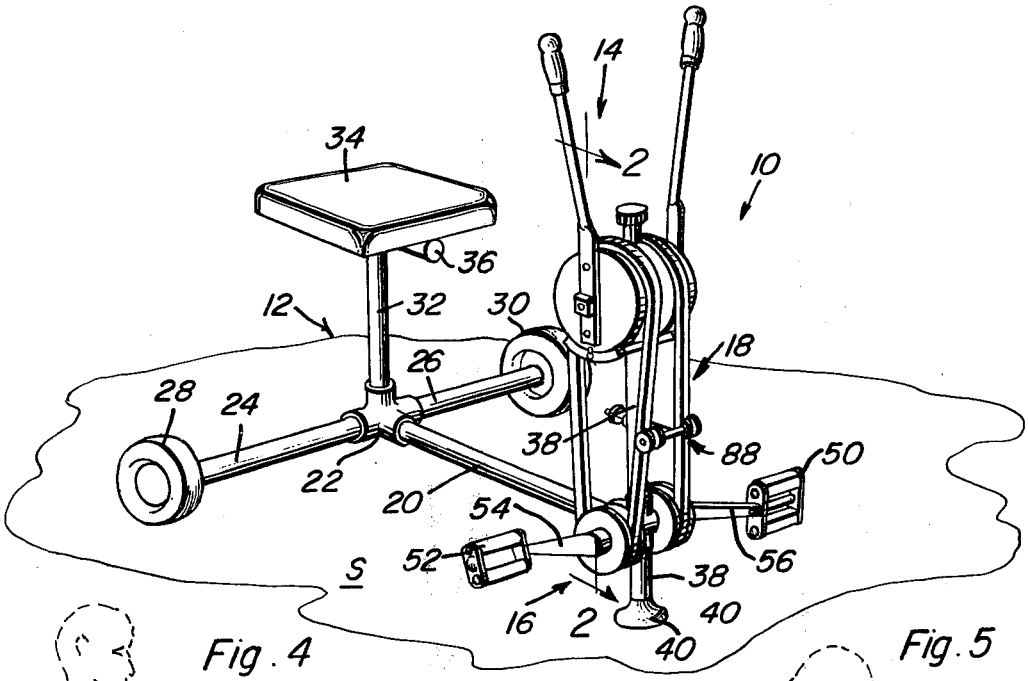
FIG. 1 is a perspective view showing an exercising machine according to the present invention.

Referring now more particularly to FIG. 1 of the drawings, an exercising machine 10 according to the present invention has a frame 12 or which is mounted a hand lever assembly 14 arranged for selective actuation by an exerciser's hands, a foot pedal assembly 16 arranged for selective actuation by an exerciser's feet, and a brake assembly 18 arranged for applying a drag to the hand lever assembly and foot pedal assembly. The foot pedal assembly 16 operates independently of hand lever assembly 14 despite the common brake assembly 18.

Figure 4:
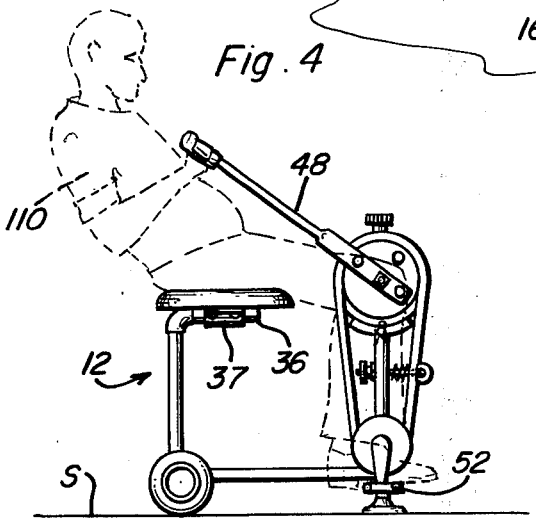
FIGS. 4 through 7 are schematic, side elevational views showing various operating positions of an exercising machine according to the present invention.
Figure 5:
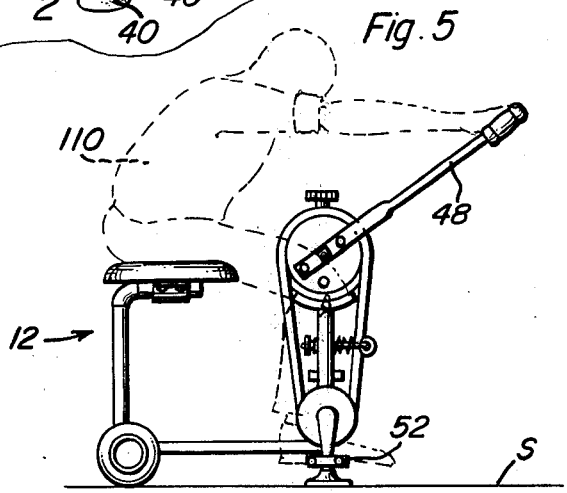

Frame 12 is constructed from a beam 20 having a fitting 22 attached to one end thereof. Fitting 22 is similar to a cross, but has one nipple rotated 90 degrees from a normal cross. Axles 24 and 26 are mounted in fitting 22 in opposed relationship so as to extend horizontally from beam 20. A pair of wheels 28 and 30 are conventionally mounted on the outboard, or free, ends of axles 24, 26 for rotation with respect to the axles. A post 32 extends upwardly from fitting 22 to provide a support for seat 34 arranged for supporting an exerciser selectively actuating the hand and foot assemblies. As can best be seen from FIG. 4 of the drawings, a brace 36 is connected to post 32 as by a conventional elbow, and seat 34 is adjustably retained on brace 36 as by a conventional clamp 37. A post 38, 38' is attached to beam 20, at an end thereof spaced from fitting 22, as by a suitable fitting 39. The latter fitting is essentially a cross with an extra nipple arranged perpendicularly to the plane in which the nipples forming the cross are arranged. A conventional suction cup 40, and the like, is advantageously provided on the lower end of post 38' for selectively anchoring frame 12 to a suitable support surface S, such as a floor and the like.

Figure 2:
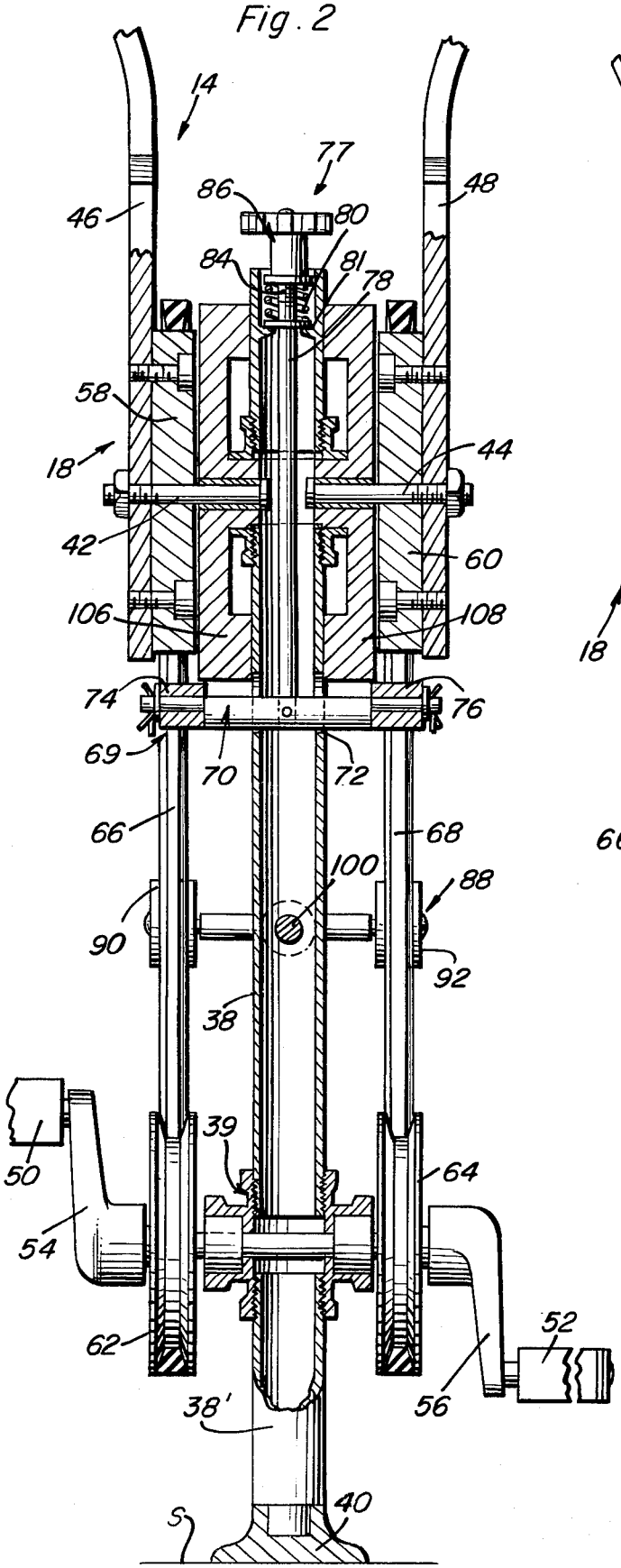
FIG. 2 is a fragmentary, sectional view taken generally along the line 2—2 of FIG. 1.
Figure 3:
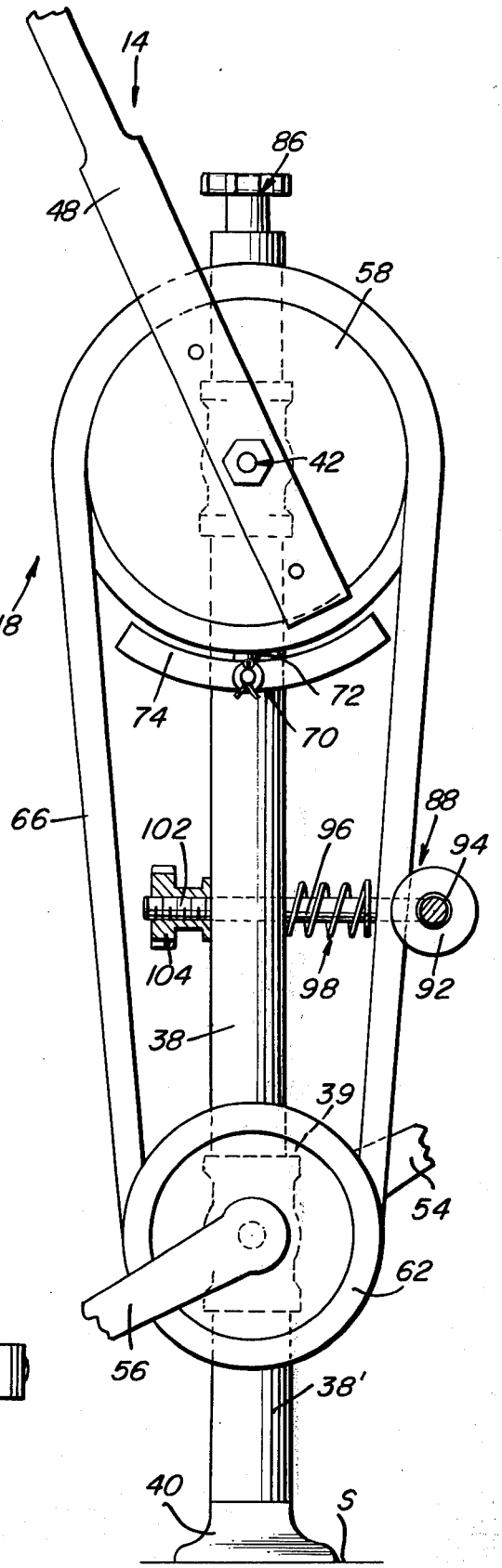
FIG. 3 is a fragmentary, side elevational view as seen from the right in FIG. 2.

Referring now to FIGS. 2 and 3 of the drawings, hand lever assembly 14 includes a pair of shafts 42 and 44 mounted on post 38, and a pair of hand levers 46 and 48 pivotally mounted on shafts 42, 44, respectively. In this manner, each of levers 46, 48 is movable independently of the other lever 48, 46. As is shown in FIGS. 2 and 3 of the drawings, shafts 42, 44 may be in the form of bolt and nut arrangements. The foot pedal assembly 16 includes a pair of pedals 50 and 52, and a pair of oppositely directed pedal cranks 54 and 56 rotatably mounted on fitting 39 and having pedals 50, 52 mounted thereon. As can be appreciated from FIG. 2, cranks 54, 56 are advantageously connected together so as to form portions of a single double-crank. Brake assembly 18 has a pair of drums 58 and 60 mounted on shafts 42 and 44. Each drum 58, 60 is connected to a respective one of levers 46, 48 to form a set therewith. A pair of pulleys 62 and 64 are associated with cranks 54 and 56, with each pulley 62, 64 mounted on a respective one of the cranks for rotation therewith.

Drums 58, 60 and pulleys 62, 64 are connected together by a pair of, for example, V-belts 66 and 68. Each belt 66, 68 is arranged over a respective one of the drums 58, 60 and an associated pulley 62, 64. If a V-belt is employed for belt 66, 68, pulleys 62, 64 are advantageously formed with V-grooves in their periphery.

A brake shoe assembly 69 is advantageously associated with hand lever assembly 14. This brake shoe assembly includes a longitudinal member 70 arranged extending through an elongated slot 72 provided in pipe 38. As can best be seen from FIG. 2 of the drawings, member 70 includes a shaft or rod portion surrounded by a collar. Brake shoes 74 and 76 are mounted on the spaced ends of the shaft or rod portion of member 70 and are arranged for selectively and variably contacting drums 58, 60. Shoes 74, 76 may be retained on member 70 in a conventional manner, such as by the illustrated cotter pins. Member 70 is adjustably mounted on post 38 as by a support arrangement 77 which permits varying of the bias of shoes 74, 76 against drums 58, 60. This support arrangement 77 includes a rod 78 pivotally connected to member 70 as by a suitable pin, a conventional coiled spring 80, and the like arranged about rod 78 and in abutting relationship with a flange 81 provided inside pipe 38, a washer 82 arranged on rod 78 in engagement with spring 80 at an end point thereof opposite abutment of spring 80 against flange 81, screw threads 84 provided on rod 78, and a thumbnut 86, and the like, threadingly engaged with threads 84. Nut 86 threadingly engages threads 84 and washer 82 for positioning the washer as a function of a desired deflection of spring 80. The deflection of spring 80 is a function of the bias of shoes 74, 76 on drums 58, 60. By threading nut 86 along threads 84, the deflection of spring 80 can be made as desired.

Brake assembly 18 may also include a tightener 88 arranged for varying the drag exerted by belts 66, 68 on drums 58, 60 and pulleys 62, 64. This tightener 88 is comprised of a pair of disks 90 and 92 rotatably mounted on a conventional axle 94. The axle 94 is in turn directed to a bar 96 which extends horizontally from axle 94 and has conventional, for example, coiled spring 98 arranged about the bar. Thus, the construction of tightener 88 is somewhat similar to the construction of brake shoe support assembly 77. Bar 96 extends through a hole 100 provided in post 38, and is itself provided with threads 102 which engage with a nut 104. This arrangement permits nut 104 to be threaded along threads 102 so as to move axially with respect to bar 96 and change the position of bar 96 relative to post 38 due to the abutment of nut 104 against post 38. This axial movement will change the deflection of spring 98 and, accordingly, the degree of tightening of belts 66, 68 due to engagement of disks 90 and 92 with the belts. Hole 100 in post 38 is elongated, to allow bar 96 which is flattened on either side to pass through. This is to hold axle 94 rigidly on a horizontal plane, else, it might twist, allowing misalignment of disks 88, 90.

Shaped blocks 106 and 108 are arranged on shafts 42 and 44 between drums 58, 60 and post 38 to provide a general bracing of hand lever assembly 14 and to properly space the various elements of that assembly. In particular, these blocks function as main bearing and support castings for shafts 42 and 44, and act as an inner guide for V-belts 66, 68. Further, blocks 106, 108 act to align the brake shoes 74, 76 with drums 58, 60 because the entire length of the, for example, metal shoes 74, 76 is in loose contact with the flange formed by blocks 106, 108, resulting in a positive alignment with the drums 58, 60. The, for example, cotter keys holding shoes 74, 76 on member 70 prevent any outward dislocation of the shoes. The V-belts 66, 68 will tend to hug the flange formed by blocks 106, 108 so at to be guided therealong.

OPERATION

Referring now to FIGS. 4 to 7 of the drawings, the use of a machine 10 according to the present invention by an exerciser 110 will now be discussed.

Figure 6:
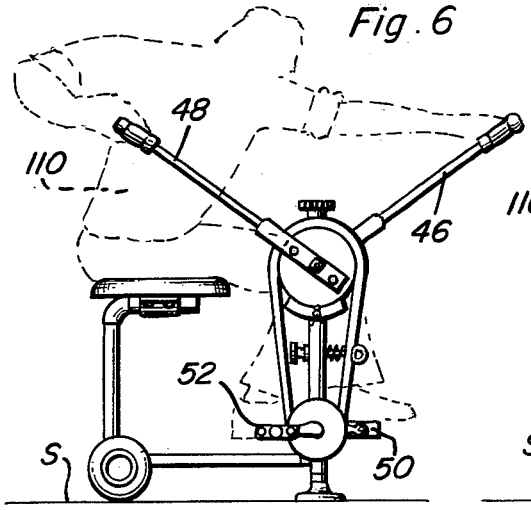
Figure 7:
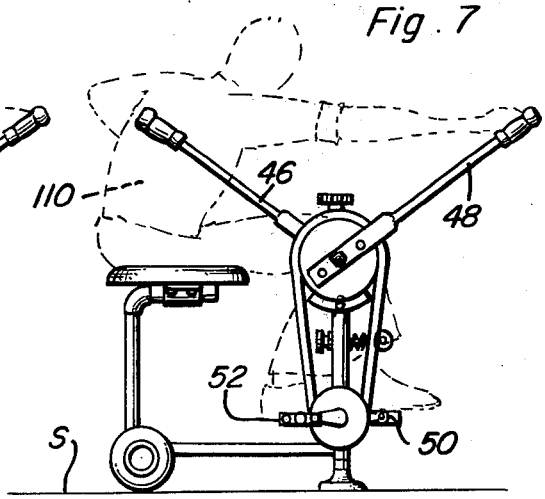

A machine 10 according to the present invention permits an exercise similar to rowing a boat. This is the exercise shown in FIGS. 4 and 5 of the drawings. FIGS. 6 and 7 of the drawings illustrate a very useful exercise, as this exercise provides for a sort of twist to the body and spine of an exerciser 110, and permits this and the rowing-like exercises to be conducted under a specific load or drag selected by the exerciser or operator.

In the two above mentioned exercises, the exerciser keeps his feet on the pedals in stop pedal position.

Another very useful and practical exercise is the pedal pumping bicycle type exercise. Here too the operator can adjust to any desired drag or load he wishes by adjusting belt tightener 88. This drag or load is the result of the V-pulleys 62, 64 gripping the V-belts 66, 68 and driving the belts up over the brake drums 58, 60. The latter has a flat surface so the V-belts actually slide over the smooth surface while the drums are held in a nonrotating position by the operator during this exercise.

A very unique and novel feature incorporated in the present invention is the two-fold braking system including brake assembly 18 and brake shoe assembly 69. First, the V-belts serve to provide all the torque or drag needed for the bicycle type exercise. The braking system used on the hand levers when using these levers in exercises also is adequate, but by using both the V-belts drag and the brake shoes drag coupled together, a much more gentle and even application of the drag or load is achieved. Further, since less pressure is needed on brake shoes 74, 76 when same are assisted by the drag of the V-belts 66, 68, the pressure of the brake shoes against the brake drums 58, 60 and the pressure from the V-belts sets up a drag across the top of the brake drums which provides a sort of a cushion-like action on shafts 42, 44 and the bearings provided by blocks 106, 108. This cushion-like action minimizes wear on both the shafts and bearings.

While suitable stops (not shown) may be provided for limiting movement of hand levers 46, 48, it is to be understood that an important feature of the present invention is the arrangement of the hand levers for movement in pairs in either direction (FIGS. 4 and 5) or in opposite directions with respect to one another (FIGS. 6 and 7).

In order to get the desired braking effect by the V-belts, the operator keeps his feet on the pedals 50, 52 in a stopped pedaling position. In other words, the belts are not moving. However, the hand lever brake drums 58, 60 are subjected to the friction created by the V-belts since the latter are partially circled around the drums. Thus, when the hand levers 46, 48 are moved, both the regular hand lever brake shoes 74, 76 and the V-belts apply a braking force to the drums 58, 60 which is gentle but positive. This procedure outlines what takes place during hand lever exercising. The brake shoe assembly 68 is also adjustable by means of support arrangement 77, so that both belts 66, 68 and shoes 74, 76 may be adjusted to achieve a desired drag. This dual-braking arrangement has several advantageous features in addition to just being a braking arrangement. First, this arrangement provides even distribution of force or load on shafts 42, 44, thus prolonging shaft and bearing life. Second, the V-belts working in conjunction with the hand lever brake shoe arrangement provide a very gentle but positive braking force while a machine 10 is being used for hand lever exercising.

When pedal pumping the exerciser, the only purpose served by the hand lever brake drum brakes is to hold the hand levers in a vertical position so the operator can rest his hands by holding onto the stationary levers. In this manner, the operator is better able to balance himself while sitting on seat 34. As mentioned above, seat 34 is movable on its brace 36 so as to accommodate short or tall people.

The second use for the V-belts is, of course, the provision of a drag or load during pedal exercising. This is accomplished by the V-belts being driven by the pedal assembly 16 over drums 58, 60. By using the tigtener 88, the amount of drag or load to be set up by the V-belts is easily determined. The drums 58 and 60 are stationary during pedaling exercises, and the friction created by the V-belts passing over the stationary drums creates the desired load or drag. An advantageous design has the belt encircling about, for example, 70% of the periphery of the brake drums.

As can be readily understood from the above description and from the drawings, and exercising machine according to the present invention provides a convenient, reliable, and versatile manner in which to exercise.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An exercising machine, comprising, in combination:

a. a frame;

b. hand means including a pair of levers independently pivotally mounted on the frame for selective actuation by an exerciser's hands;

c. brake means for applying a drag independently and equally to each of the levers; and d. foot means including a pair of pedals pivotally mounted on the frame for selective actuation by an exerciser's feet, and wherein the brake means also applies a drag to the pedals, the hand means including a pair of shafts mounted on the frame and the pair of hand levers pivotally mounted on the shafts, whereby each of the hand levers is movable independently of the other of the hand levers, the foot means including a pair of oppositely directed pedal cranks rotatably mounted on the frame, and each of the pedals mounted on a respective one of the pedal cranks, and the brake means including a pair of drums mounted on the shafts, each drum connected to a respective one of the hand levers to form a set therewith, a pair of pulleys, each pulley mounted on a respective one of the pedal cranks for rotation therewith, and a pair of belts, each belt arranged over a respective one of the drums and an associated one of the pulleys.

2. A structure as defined in claim 1, wherein the brake means furthher includes a brake shoe assembly comprising;

i. a horizontal member;

ii. a pair of brake shoes mounted on the member and arranged for contacting the drums; and iii. support means for adjustably mounting the member on the frame and permitting varying of the bias of the brake shoes against the drums.

3. A structure as defined in claim 2, wherein the support means includes a rod pivotally connected to the member at a point thereon between the brake shoes, a coiled spring having coils arranged about the rod and an end coil thereof abutting the frame, a washer arranged on the rod and engaging an end coil of a spring spaced from the end coil abutting the frame, screw threads provided on the rod, and a nut threadingly engaged with the screw threads of the rod and contacting the washer foor positioning the washer as a function of a desired deflection of the spring, the spring deflection being a function of the bias of the brake shoes on the drums.

4. A structure as defined in claim 3, wherein a seat is provided on the frame and is arranged for supporting an operator selectively actuating the hand and foot means.

5. An exercising machine, comprising, in combination:

a. a frame;

b. hand means including a pair of levers independently pivotally mounted on the frame for selective actuation by an exerciser's hands;

c. brake means for applying a drag independently and equally to each of the levers; and d. foot means including a pair of pedals pivotally mounted on the frame for selective actuation by an exerciser's feet, and wherein the brake means also applies a drag to the pedals, the hand means including a pair of shafts mounted on the frame, and the pair of hand levers pivotally mounted on the shafts, whereby each of the hand levers is movable independently of the other of the hand levers, and the brake means including a brake shoe assembly comprising;

i. a pair of drums mounted on the shafts, each drum connected to a respective one of the hand levers to form a set therewith;

ii. a pair of brake shoes arranged for contacting the drums; and iii. support means for adjustably mounting the brake shoes on the frame and permitting varying of the bias of the brake shoes against the drums, the support means including a member, a rod pivotally connected to the member at a point thereon between the brake shoes, a coiled spring having coils arranged about the rod and an end coil thereof abutting the frame, a washer arranged on the rod and engaging an end coil of a spring spaced from the end coil abutting the frame, screw threads provided on the rod, and a nut threadingly engaged with the screw threads of the rod and contacting the washer for positioning the washer as a function of a desired delfection of the spring, the spring deflecting being a function of the bias of the brake shoes on the drums.

6. A structure as defined in claim 5, wherein the foot means includes a pair of oppositely directed pedal cranks rotatably mounted on the frame, and a pair of pedals, each of the pedals mounted on a respective one of the pedal cranks.

7. A structure as defined in claim 5, wherein a seat is provided on the frame and is arranged for supporting an operator selectively actuating the hand and foot means.

8. An exercising machine, comprising, in combination:

a. a frame;

b. hand means including a pair of levers independently pivotally mounted on the frame for selective actuation by an exerciser's hands; and c. brake means for applying a drag independently and equally to each of the levers, the hand means further including a pair of shafts mounted on the frame, and the pair of hand levers pivotally mounted on the shafts, whereby each of the hand levers is movable independently of the other of the hand levers, the brake means including a brake shoe assembly comprising;

i. a pair of drums mounted on the shafts, each drum connected to a respective one of the hand levers to form a set therewith;

ii. a pair of brake shoes arranged for contacting the drums; and iii. a support means for adjustably mounting the brake shoes on the frame and permitting varying of the bias of the brake shoes against the drums, the support means including a member, a rod pivotally connected to the member at a point thereon between the brake shoes, a coiled spring having coils arranged about the rod and an end coil thereof abutting the frame, a washer arranged on the rod engaging an end coil of a spring spaced form the end coil abutting the frame, screw threads provided on the rod, and a nut threadingly engaged with the screw threads of the rod and contacting the washer for positioning the washer as a function of a desired deflection of the spring, the spring deflecting being a function of the bias of the brake shoes on the drums.

* * * * *